US006523200B2

(12) United States Patent
Brown

(10) Patent No.: US 6,523,200 B2
(45) Date of Patent: Feb. 25, 2003

(54) NECK SUPPORT PILLOW WITH BIB

(76) Inventor: Susan Matthews Brown, 29753 Canterbury Cir., Evergreen, CO (US) 80439

( * ) Notice: Subject to any disclaimer, the term of this patent is extended or adjusted under 35 U.S.C. 154(b) by 0 days.

(21) Appl. No.: 09/852,860

(22) Filed: May 9, 2001

(65) Prior Publication Data

US 2002/0166173 A1 Nov. 14, 2002

(51) Int. Cl.[7] ..... A41B 13/00
(52) U.S. Cl. ..... 5/639; 5/655; 5/637; 2/49.1
(58) Field of Search ..... 5/636, 637, 640, 5/484, 655; 297/393; 2/49.1, 49.2, 49.5

(56) References Cited

U.S. PATENT DOCUMENTS

| | | | | |
|---|---|---|---|---|
| 1,898,272 A | | 2/1933 | Stern | |
| 2,078,022 A | | 4/1937 | Roemer | 5/655 |
| 2,379,340 A | | 6/1945 | Corbett | 4/185 |
| 3,378,948 A | | 4/1968 | Gervaise | 5/904 |
| 3,426,372 A | * | 2/1969 | Enelow | 5/490 |
| 3,608,964 A | * | 9/1971 | Earl | 297/397 |
| 3,840,918 A | * | 10/1974 | Shave | 5/421 |
| 4,197,604 A | | 4/1980 | Nakamura | 5/437 |
| 4,236,264 A | | 12/1980 | Britzman | 5/435 |
| 4,731,890 A | | 3/1988 | Roberts | 5/431 |
| 4,914,765 A | | 4/1990 | Smith | 5/434 |
| 5,154,649 A | | 10/1992 | Pender | 5/655 |
| 5,193,235 A | | 3/1993 | Kircher | 5/413 |
| 5,207,791 A | | 5/1993 | Scherbarth | 273/148 B |
| 5,261,134 A | | 11/1993 | Matthews | 5/655 |
| 5,519,906 A | | 5/1996 | Fanto-Chan | 5/631 |
| 5,546,620 A | | 8/1996 | Matthews | 5/655 |
| 5,572,753 A | * | 11/1996 | Ruscitto | 112/475.08 |
| 5,581,833 A | | 12/1996 | Zenoff | 5/655 |
| 5,661,861 A | | 9/1997 | Matthews | 5/633 |
| 5,666,665 A | * | 9/1997 | Morgado | 2/49.1 |
| 5,675,853 A | * | 10/1997 | Linge | 5/417 |
| 6,038,720 A | | 3/2000 | Matthews et al. | |
| 6,055,687 A | | 5/2000 | Matthews | |
| 6,119,873 A | | 9/2000 | Matthews | |

FOREIGN PATENT DOCUMENTS

| | | |
|---|---|---|
| FR | 2 379 268 | 9/1978 |
| GB | 1 508 809 | 4/1978 |
| WO | WO 94/09689 | 5/1994 |

* cited by examiner

*Primary Examiner*—Michael F. Trettel
(74) *Attorney, Agent, or Firm*—Townsend and Townsend and Crew LLP

(57) ABSTRACT

A neck pillow comprises a pillow body having a medial region and two opposing arms that extend from the medial region to form a generally open well. A bib is coupled to the pillow body.

12 Claims, 4 Drawing Sheets

NECK SUPPORT PILLOW WITH BIB

BACKGROUND OF THE INVENTION

This invention relates generally to the field of child products, and in particular to bibs. More specifically, the invention relates to the use of bibs that are attached to neck pillows.

Bibs have long been used to protect a child from food, saliva, or the like. Bibs are typically constructed of a piece of material that is coupled about the child's neck using a pair of strings or other fastener, such as snaps or a VELCRO fastener material. This invention is related to other ways to secure a bib to a child.

BRIEF SUMMARY OF THE INVENTION

The invention provides techniques for securing a bib to a person, such as child or an infant, in a manner such that the bib may easily be removed when needed. In one embodiment, a neck pillow comprises a pillow body having a medical region and two opposing arms that extend from the medial region to form a generally open well. A bib is coupled to the pillow body. In this way, the bib may be secured to the child simply by inserting the arms around the child's neck. As such, the bib is both easy to put on and to remove. By using a neck pillow, the child's head is also supported.

In one aspect, the pillow body includes an outer periphery and an inner periphery that defines the well. With such a configuration, the bib may be coupled to the medial region at the outer periphery. In this way, the arms may be placed about the child's neck so that ends of the arms are at the back of the neck while the medial region is at the front of the neck. In this manner, the bib hangs vertically down over the child's chest.

The bib may be constructed of a flexible material to permit the bib to hang from the pillow body. For example, the bib may comprise a sheet of plastic or fabric. In one aspect, the bib may have a length of about 5 in to about 10 in, and is configured to hang below the pillow body by a distance of about 3 in to about 8 in, although in some cases the bib could be longer.

In one particular aspect, the pillow body may comprise a fill material that is covered by a fabric cover. Such a fabric cover may be constructed of two halves that are sewn together to form seam lines extending around the outer periphery and the inner periphery. With such a configuration, the bib may be sewn to the seam at the outer periphery.

In one alternative, the bib may be removably coupled to the pillow body by at least one fastener. For example, the bib may be coupled to the pillow body by snaps, a hook and loop fastener material, buttons, or the like. In this way, the bib may be removed for cleaning or replacement.

In another aspect, the arms may be curved such that their ends generally face each other. In this way, the ends may be pulled apart from each other when placing the arms about the child's neck. In a further aspect, the largest dimension across the well is in the range from about 2.5 in to about 4 in so that the neck pillow is suitable for use with a child. In some cases, the well size could be larger for larger individuals.

DESCRIPTION OF THE SPECIFIC EMBODIMENTS

The invention provides techniques for removably attaching a bib to a child. The techniques of the invention may be used with children of any age or size, including infants to older children, and could even be used for adults. The bibs are attached to the person by using a neck pillow that is placed about the person's neck and rests on the person's shoulders.

The neck pillow is constructed of a pillow body, having a medial region and two opposing arms that define a generally open well for receiving the neck. The neck pillow may conveniently be constructed in a manner similar to the pillows described in U.S. Pat. Nos. 5,261,134; 5,661,861; 6,038,720; 6,055,687; 6,119,873; and 5,546,620 and copending U.S. application Ser. No. 09/802016, filed Mar. 8, 2001; Ser. No. 09/799759, filed Mar. 6, 2001; Ser. No. 09/662935, filed Sep. 15, 2000; Ser. No. 09/662513, filed Sep. 14, 2000; and Ser. No. 09/802310, filed Mar. 8, 2001, the disclosures of which are herein incorporated by reference. However, it will be appreciated that other pillows that are capable of being placed about the neck may also be used, including U-shaped pillows, angular pillows and the like. The neck pillows may have a well that is about 2.5 in to about 4 in across so that it is large enough to receive the child's neck without choking the child, but small enough so that the pillow remains secured about the neck. The pillow may have a variety of shapes so long as the pillow is able to remain secured to the neck. For example, the opposing arms may be straight, angled or curved. The medial region may have a shape and size to facilitate coupling of the bib to the pillow body. For example the medial region could be generally straight and have a length approximately equal to the length of the bib.

The bib may conveniently be coupled to the media region so that when the medial region is at the front of the child's neck, the bib hangs down over the child's chest. The size of the bib may be configured according to the size of the child. In on embodiment, the bib has a length in the range from about 5 in to about 10 in and hangs down from the medial region by a distance of about 3 in to about 8 in, and in some cases may be longer, e.g., about 12 inches. Further, the bib may have a variety of shapes, such as rectangular, curved, scalloped, and the like.

A variety of materials may be used to construct the bib. For example, the bib may be constructed of a fabric, such as a cotton or polyester cloth material, plastics, and the like. The bib may conveniently include one or more pockets for storing items or for simply catching food. The bib may be either integrally attached or removably attached to the pillow body. For example, the bib may be sewn or glued to the pillow body. Alternatively, a variety of fasteners may be used to removably attach the bib to the pillow body including buttons, snaps, a hook and loop fastener material, or the like.

Figure 1:
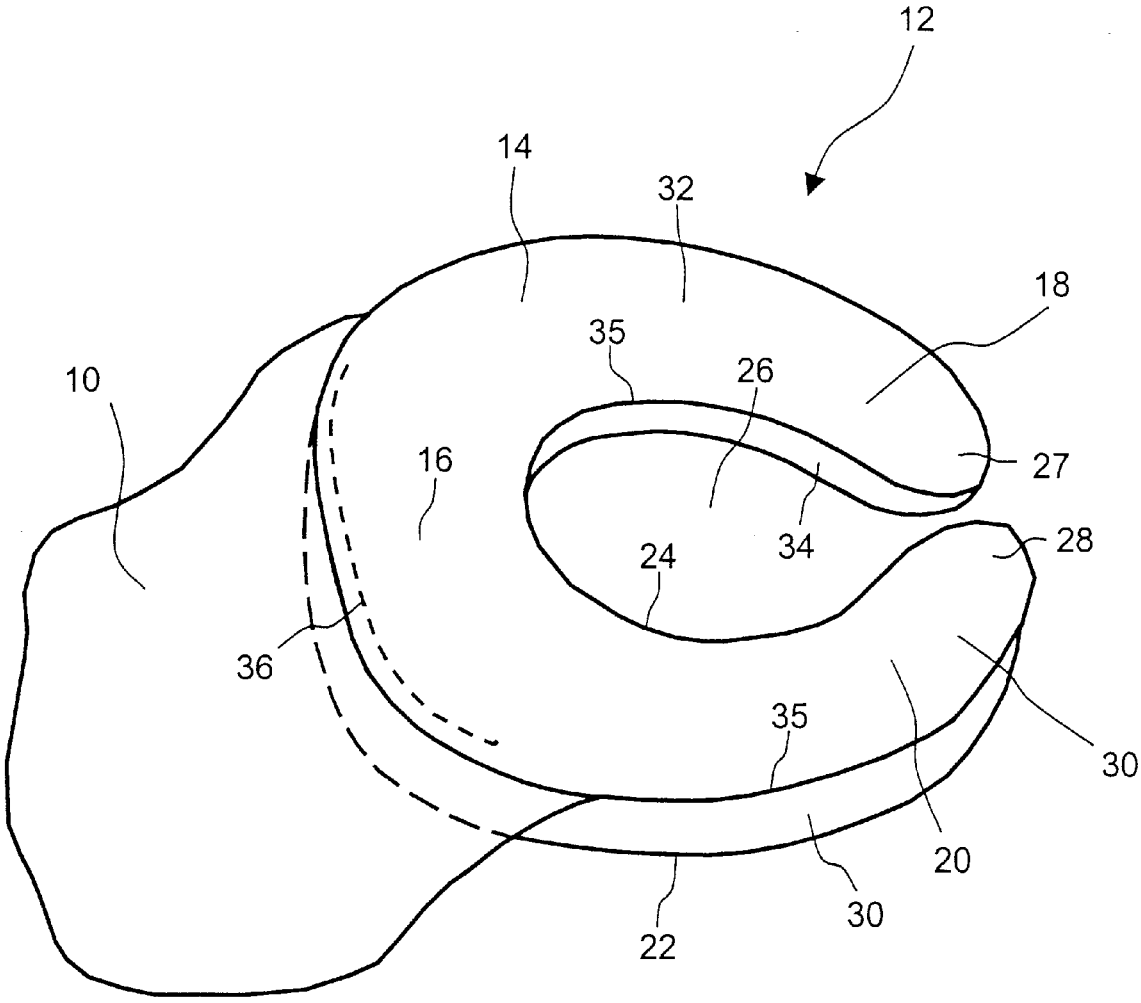
FIG. 1 is a perspective view of a neck pillow having an attached bib according to the invention.
Figure 2:
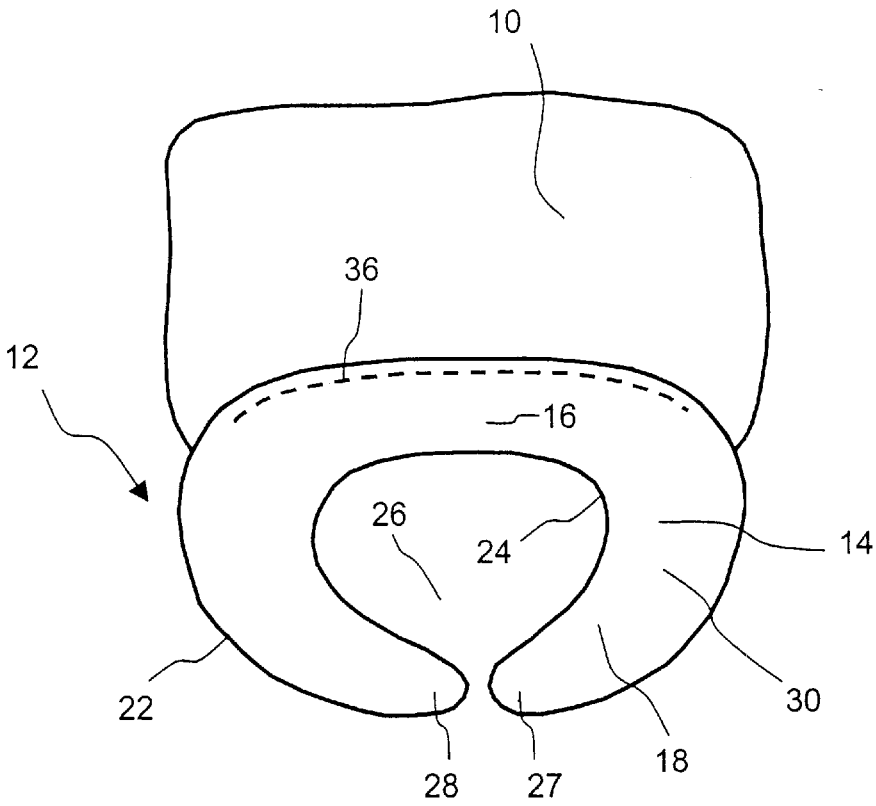
FIG. 2 is a top plan view of the neck pillow and bib of FIG. 1.
Figure 3:
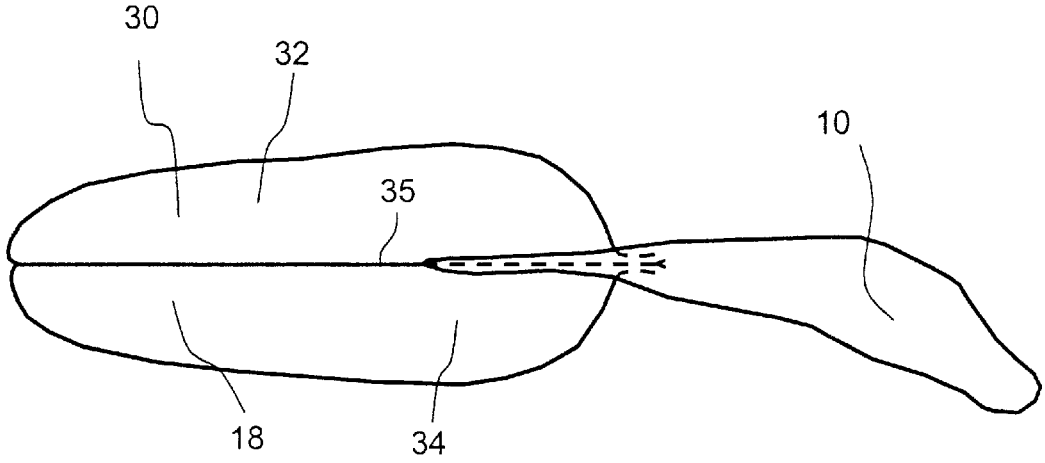
FIG. 3 is a side view of the pillow and bib of FIG. 2.

Referring now to FIGS. 1–3, one embodiment of a bib 10 that is coupled to a neck pillow 12 will be described. Pillow 12 comprises a pillow body 14 having a medial region 16 and two arms 18 and 20 that extend from medial region 16. Pillow body 14 includes an outer periphery 22 and an inner periphery 24 that outlines a generally open well 26. Arms 18 and 20 are somewhat curved and have ends 27 and 28 that generally face each other.

Pillow body 14 is constructed of a fill material, such as a hypoallergenic fill material that is encased in a fabric cover 30. Conveniently, pillow body 14 may be constructed using any of the techniques described in U.S. Pat. Nos. 5,261,134; 5,661,861; 6,038,720; 6,055,687; 6,119,873; and 5,546,620 and copending U.S. application Nos. 09/802016, filed Mar. 8, 2001; Ser. No. 09/799759, filed Mar. 6, 2001; Ser. No. 09/662935, filed Ser. 15, 2000; Ser. No. 09/662513, filed Sep. 14, 2000; and Ser. No. 09/802310, filed Mar. 8, 2001, previously incorporated by reference. As shown, cover 30 comprises two halves 32 and 34 that are sewn together to form an inner seam 35 that extends around outer periphery 22 and inner periphery 24.

Figure 3A:
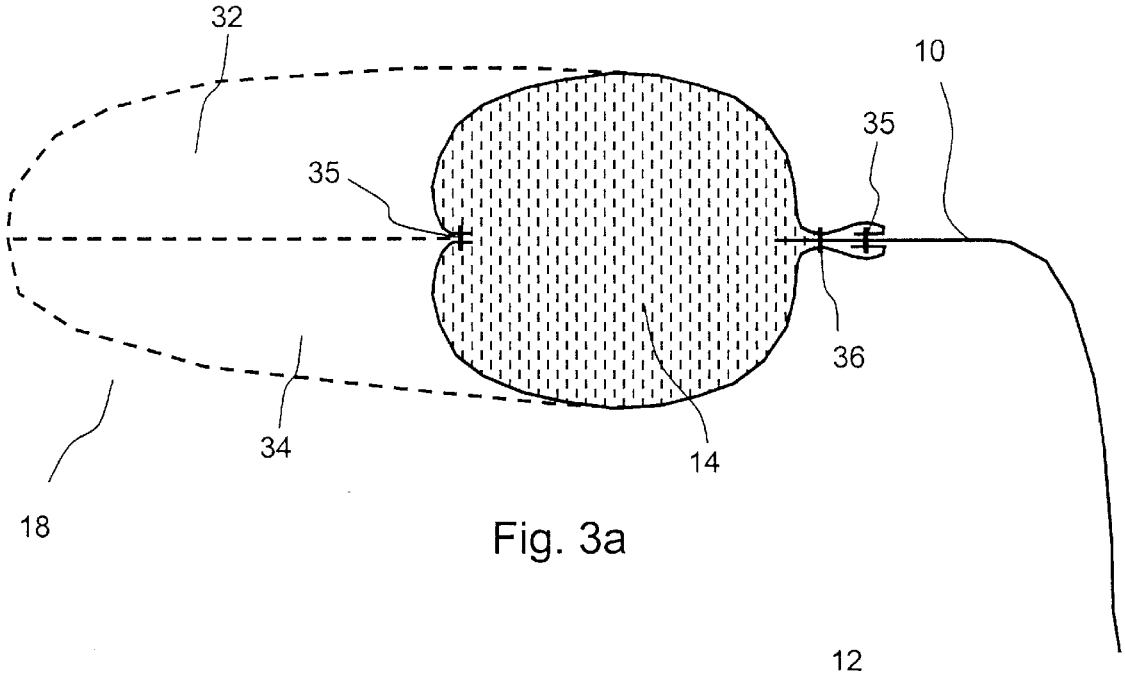
FIG. 3*a* is a cross sectional view of the pillow and bib of FIG. 3.

Bib 10 is sewn to pillow body 14 by placing bib 10 between halves 32 and 34 when sewing halves 32 and 34 together. As best shown in FIGS. 2 and 3*a,* bib 10 may be sewn to pillow body 14 along inner seam 35. Halves 32 and 34 may optionally be pinched and sewn together along a central part of bib 10 to form a second or exterior seam 36 that is exterior to pillow body 14. However, it will be appreciated that other schemes may be used to sew bib 10 to pillow body 14, as well as the use of other fasteners.

To fit around the child's neck, well 26 may be about 2.5 in to about 4 in across. Medial region 16 may have a length of about 5 in to about 10 in. Bib 10 may have a length of about 5 in to about 10 in and may extend below pillow body 14 by a distance of about 3 in to about 8 in, and in some cases may be longer. In this way, bib 10 will provide some protection to the child's chest from food, saliva or other material that may potentially be spilled onto the child. As such, bib 10 may be constructed of essentially any type of protective material.

Figure 4:
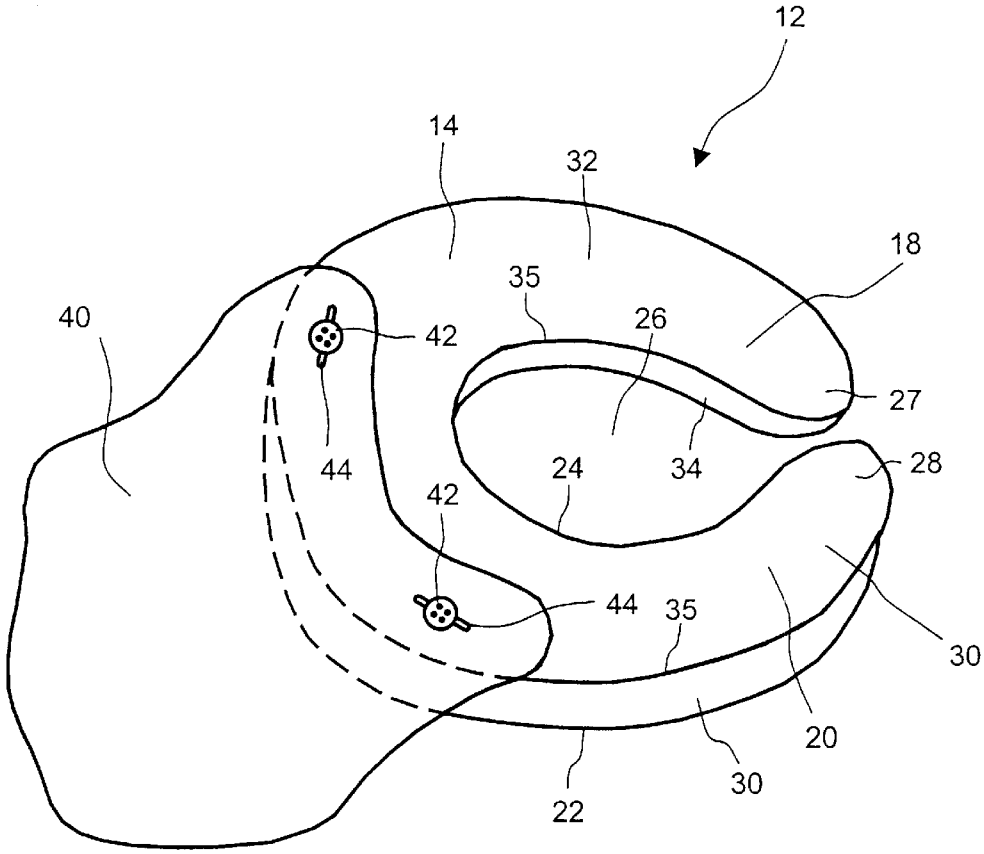
FIG. 4 illustrates a bib that is removably attached to the pillow of FIG. 1.

As previously described, other techniques may be used to couple a bib to a neck pillow. Shown in FIG. 4 is pillow 12 to which a bib 40 is removably coupled. Pillow 12 includes a pair of buttons 42 that are received into holes 44 of bib 40 to removably hold bib 40 to pillow 12. Although shown with two buttons, it will be appreciated that any number may be used. Further, alternative attachment mechanisms include snaps, clips, strings, connector materials, and the like.

Figure 5:
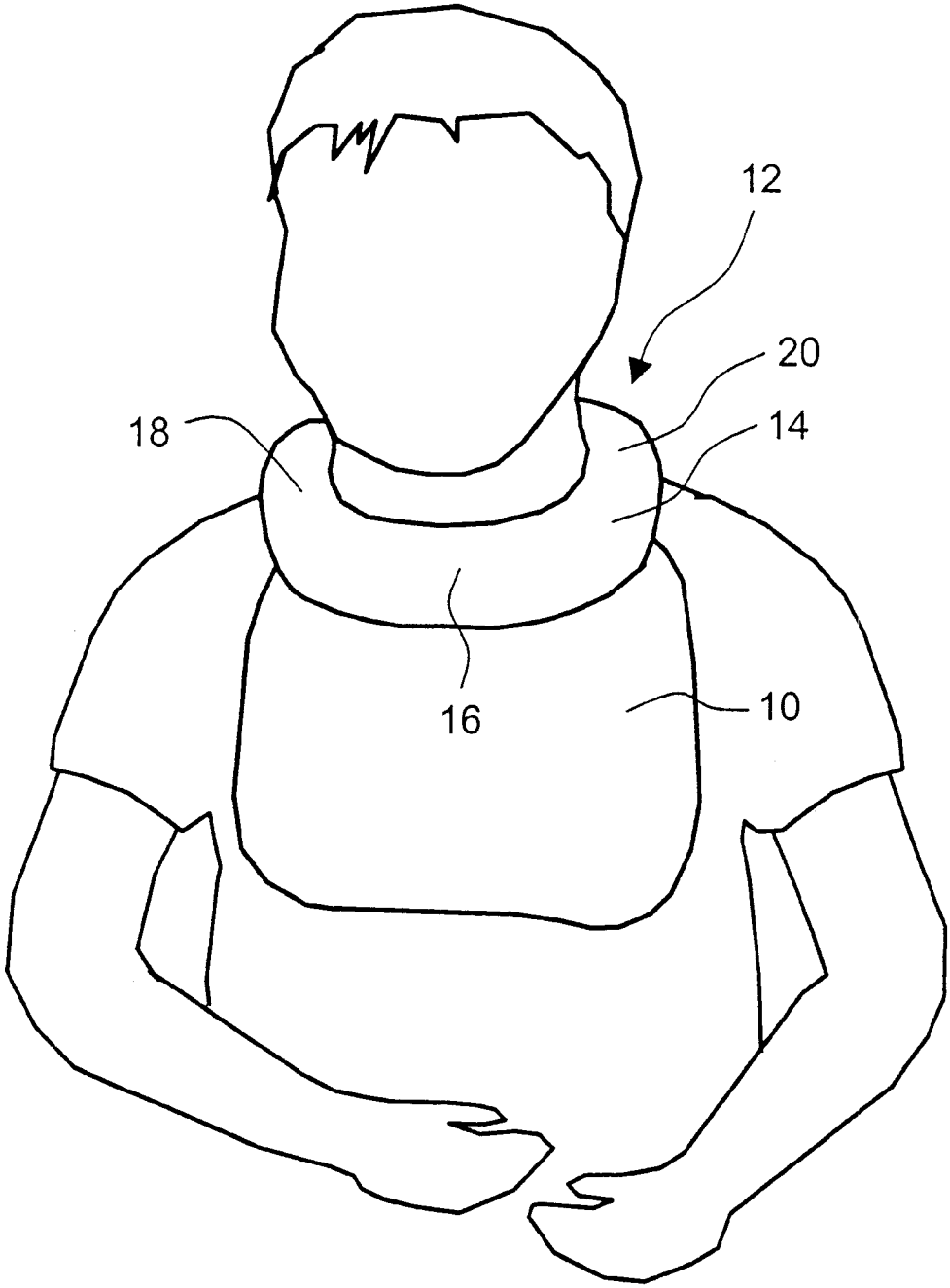
FIG. 5 illustrates the pillow and bib of FIG. 1 when worn by a child according to the invention.

In use, pillow 12 is placed around the person's neck as shown in FIG. 5. Arms 18 and 20 are resilient to permit them to be separated when placing pillow 12 about the neck. Once in place, arms 18 and 20 may be released where they spring back to their original position as shown in FIG. 1 to hold pillow 12 about the person's neck. Pillow 12 may also rest somewhat on the person's shoulders.

Pillow 12 is placed about the person's neck such that ends 27 and 28 are generally at the back of the neck while medial region 16 is at the front of the neck. As such, bib 10 hangs down over the person's chest. To remove pillow 12, it may simply be pulled forward, with arms 18 and 20 separating to clear the neck. In this way, the bib may be attached to and removed from a person in an easy and convenient manner, without requiring the operation of a fastener to hold the bib to the person.

The invention has now been described in detail for purposes of clarity and understanding. However, it will be appreciated that certain changes and modifications may be practiced within the scope of the appended claims.

What is claimed is:

1. A neck pillow comprising:

a pillow body comprising a medial region and two opposing arms that extend from the medial region to form a generally open well, wherein the pillow body includes an outer periphery and an inner periphery that defines the well, and wherein a largest distance across the well is in the range from about 2 inches to less than 4 inches; and a bib coupled to the pillow body at the medial region, wherein the bib comprises a flexible material that hangs vertically below the pillow body when the pillow body is held in a generally horizontal orientation, wherein the bib has a length defined in the direction along the medial region of about 5 inches to about 10 inches, and wherein the bib hangs below the pillow body by a distance of about 3 inches to about 8 inches.

2. A pillow as in claim 1, wherein the bib comprises a sheet of fabric.

3. A pillow as in claim 1, wherein the pillow body comprises a fill material that is covered by a fabric cover.

4. A pillow as in claim 3, wherein the fabric cover comprises two halves that are sewn together to form seam lines extending around the outer periphery and the inner periphery, and wherein the bib is sewn to the seam at the outer periphery.

5. A pillow as in claim 1, wherein the bib is removably coupled to the pillow body by at least one fastener.

6. A pillow as in claim 1, wherein each arm has a distal end, and wherein the arms are curved such that their ends generally face each other.

7. A neck pillow comprising:

a pillow body comprising a medial region and two opposing arms that extend from the medial region to form a generally open well, wherein the pillow body includes an outer periphery and an inner periphery that defines the well, and wherein a largest distance across the well is in the range from about 2 inches to less than 4 inches; and a fabric bib coupled to the pillow body at a location on the outer periphery of the medial region such that the bib hangs vertically from the pillow body when the pillow body is held in a generally horizontal orientation.

8. A method for securing a bib to a child, the method comprising:

providing a neck pillow comprising a pillow body comprising a medial region and two opposing arms that extend from the medial region to form a generally open well, and a bib that is coupled to the pillow body;

placing the pillow body around a child's neck, with the medial region being at a front of the child's neck such that the bib hangs down from the pillow body to generally cover the child's chest.

9. A method as in claim 8, wherein the step of placing the pillow body around the child's neck comprising separating the arms and placing the arms around the neck such that ends of the arms are at a back of the child's neck.

10. A method as in claim 8, further comprising removing the bib from the medial region to clean the bib.

11. A method as in claim 10, wherein the removing step comprising operating a fastener to release the bib from the medial region.

12. A neck pillow comprising:

a pillow body comprising a medial region and two opposing arms that extend from the medial region to form a generally open well, wherein the pillow body includes an outer periphery and an inner periphery that defines the well; and a bib coupled to the pillow body at the medial region, wherein the bib comprises a flexible material that hangs vertically below the pillow body when the pillow body is held in a generally horizontal orientation, wherein the bib has a length defined in the direction along the medial region of about 5 inches to about 10 inches, and wherein the bib hangs below the pillow body by a distance of about 3 inches to about 8 inches;

wherein the pillow body comprises a fill material that is covered by a fabric cover, wherein the fabric cover comprises two halves that are sewn together to form seam lines extending around the outer periphery and the inner periphery, and wherein the bib is sewn to the seam at the outer periphery.

* * * * *